US008763188B2

(12) United States Patent
Dombro

(10) Patent No.: US 8,763,188 B2
(45) Date of Patent: Jul. 1, 2014

(54) POWERED SCRUBBING DEVICE

(76) Inventor: Jeffrey S. Dombro, Stevenson Ranch, CA (US)

( * ) Notice: Subject to any disclaimer, the term of this patent is extended or adjusted under 35 U.S.C. 154(b) by 0 days.

(21) Appl. No.: 13/354,807

(22) Filed: Jan. 20, 2012

(65) Prior Publication Data

US 2012/0186031 A1 Jul. 26, 2012

Related U.S. Application Data

(60) Provisional application No. 61/435,067, filed on Jan. 21, 2011.

(51) Int. Cl.
*A47L 23/02* (2006.01)

(52) U.S. Cl.
USPC ..... 15/21.1; 15/34; 15/36

(58) Field of Classification Search
USPC ..... 15/21.1, 30, 31, 36, 34, 35, 161; 4/606
See application file for complete search history.

(56) References Cited

U.S. PATENT DOCUMENTS

| | | | | | |
|---|---|---|---|---|---|
| 866,019 | A | | 9/1907 | Handel | |
| 2,876,765 | A | | 3/1959 | Day | |
| 3,060,475 | A | * | 10/1962 | Dufault | 15/36 |
| 3,066,338 | A | * | 12/1962 | Nappi | 15/34 |
| 3,787,918 | A | * | 1/1974 | Ebert | 15/31 |
| 3,802,421 | A | | 4/1974 | Williams | |
| 3,810,463 | A | | 5/1974 | Krummenacher | |
| 3,831,217 | A | * | 8/1974 | Odawara | 15/34 |
| 3,973,286 | A | | 8/1976 | Logan | |
| 4,040,132 | A | | 8/1977 | Braun | |
| 4,446,855 | A | * | 5/1984 | Friedson | 601/15 |
| 4,712,265 | A | | 12/1987 | Williams | |
| 6,178,970 | B1 | | 1/2001 | Purifoy et al. | |
| 6,499,171 | B2 | * | 12/2002 | Nappi, Sr. | 15/36 |
| 6,813,795 | B2 | * | 11/2004 | Graves | 15/36 |
| 7,114,212 | B1 | * | 10/2006 | Watts | 15/36 |
| 8,161,590 | B2 | * | 4/2012 | Feeg et al. | 15/34 |
| 2008/0104782 | A1 | * | 5/2008 | Hughes | 15/30 |
| 2008/0256728 | A1 | * | 10/2008 | Feeg et al. | 15/34 |
| 2009/0241257 | A1 | * | 10/2009 | Malta | 4/606 |
| 2010/0306935 | A1 | * | 12/2010 | De Florian et al. | 15/30 |
| 2012/0090106 | A1 | * | 4/2012 | Jaeger | 15/21.1 |

FOREIGN PATENT DOCUMENTS

| | | | | |
|---|---|---|---|---|
| DE | 4018849 | A1 * | 12/1991 | A47L 23/02 |

* cited by examiner

*Primary Examiner* — Monica Carter
*Assistant Examiner* — Michael Jennings
(74) *Attorney, Agent, or Firm* — McCracken & Frank LLC

(57) ABSTRACT

A powered scrubbing device includes a portable housing, a source of motive power, and a scrubber member. The source of motive power is coupled to the scrubber member, and the scrubber member is journaled for rotation within a recess of the housing. The recess is sized to accommodate a foot of a user below the scrubber member, and the recess is sized to permit access to an upper surface of the scrubber member.

20 Claims, 8 Drawing Sheets

POWERED SCRUBBING DEVICE

CROSS REFERENCE TO RELATED APPLICATIONS

The present application claims the benefit of provisional U.S. Patent Application No. 61/435,067, filed Jan. 21, 2011, the disclosure of which is hereby incorporated by reference.

REFERENCE REGARDING FEDERALLY SPONSORED RESEARCH OR DEVELOPMENT

Not applicable

SEQUENTIAL LISTING

Not applicable

BACKGROUND OF THE DISCLOSURE

1. Field of the Background

The present disclosure generally relates to powered scrubbing devices, and more particularly to portable powered scrubbing devices for use in a wet environment.

2. Description of the Background

Good hygienic habits are important for good health. These habits include the need to clean one's body periodically and/or treat one's skin. The feet are a particular target for dirt, bacteria, and fungi, and can further benefit from exfoliation, i.e., the removal of dead and/or dry skin and calluses. However, feet can be difficult to reach for cleaning and exfoliation, not only by healthy persons, but particularly by persons who are aged, have a disability that limits movement, and/or who cannot care for themselves. Further, certain diseases of the feet, including fungal infections of the skin or nails of the feet, can be treated by scrubbing of the affected area, often with a cleaning agent and/or an antifungal agent. The scrubbing process typically involves greater physical exertion than washing alone, may be difficult for an otherwise healthy person, and may not result in effective treatment or even be feasible by a person of limited physical and/or mental capacity.

Devices have been designed to assist in cleaning one's feet. One such device is disclosed in Logan U.S. Pat. No. 3,973,286, which comprises a series of brushes, some of which are stationary and two of which are rotatable, and which are mounted in a bracket or housing. The brushes extend into a recess that is sized to accept a foot of a user. The device is intended to be used in a wet environment. The user inserts his/her foot into the recess and moves the foot in a back-and-forth motion to rotate the rotatable brushes and thereby scrub portions of the foot. A drawback of this device is that it requires a user to balance on a second foot while moving the foot within the device, which can be dangerous in a wet environment, especially for those who are aged or those who have a disability that limits motion.

Still further devices have been developed to clean one's feet in a shower or bath. These devices include stationary brushes arranged about a recess within which a user may move his/her foot back and forth. When used in a shower, these devices suffer from the same disadvantages as the Logan device noted above. When used in a bath, the user must be sufficiently dexterous to balance within the bath, while moving the foot within the device.

Yet other devices, which are hand-held, have been developed to permit scrubbing and/or exfoliation of one's feet. An example of the latter is the Ped Egg™, which includes a first portion having a series of sharp cutting edges and a second portion having an emery surface.

Another hand-held device designed to assist in cleaning and exfoliating one's feet is a foot sander disclosed in Purifoy et al. U.S. Pat. No. 6,178,970. The foot sander comprises a body member shaped to fit in a user's hand, and a scrubbing head disposed at one end of the body member. A battery in the body member provides power to a motor coupled to the scrubbing head and that is operable to cause the scrubber head to move in an orbital motion. These hand-held devices ignore the at-times significant challenges of having to reach the feet for cleaning.

Devices have been designed to assist in cleaning other parts of the body. One such device is a backscrubber disclosed in Braun U.S. Pat. No. 4,040,132. This device includes scrubbers mounted within a casing recessed within a wall of a shower enclosure. A motor used for powering the scrubbers is located outside of the shower enclosure, and the motor is connected to the scrubbers through a drive line and transmission system located behind the shower wall. Although, this device provides motive power to the brushes, it lacks the benefits of a portable device, and to be used to clean feet.

SUMMARY OF THE DISCLOSURE

According to one embodiment, a powered scrubbing device comprises a portable housing having a recess disposed within outer margins of the housing, wherein the recess is defined by first and second opposing side walls and a third side wall extending transversely between the first and second side walls. The first and second opposing side walls extend between front and rear faces of the housing. A scrubber member is journaled for rotation within the recess and a source of motive power is coupled to the scrubber member selectively in either of first and second directions. The scrubber member divides the recess into first and second recess portions, wherein the first recess portion is sized to accommodate a foot of a user and the second recess portion permits access to an upper surface of the scrubber member. The first and second opposing side walls have a first height and the third side wall has a second height less than the first height such that the upper surface of the scrubber member is accessible from the front and rear faces of the housing.

According to another embodiment, a powered scrubbing device comprises a portable, waterproof housing having a recess defined by a first and second opposing side walls and a third side wall extending perpendicularly between and connecting the first and second side walls. The first and second opposing side walls extend between front and rear faces of the housing. A scrubber member is journaled for rotation within the recess, and an electric motor disposed within the housing is coupled to the scrubber member to rotate the scrubber member selectively in either of first and second directions. The scrubbing device also includes a battery disposed within the housing and coupled to the motor and a switch for controlling motor actuation. The recess is sized to accommodate a foot of a user below the scrubber member and the recess is sized to permit access to an upper surface of the scrubber member. The first and second opposing side walls have a first height and the third side wall has a second height less than the first height such that the upper surface of the scrubber member is accessible from the front and rear faces of the housing.

Other aspects and advantages of the present disclosure will become apparent upon consideration of the following detailed description.

DETAILED DESCRIPTION OF THE DRAWINGS

Figure 1:
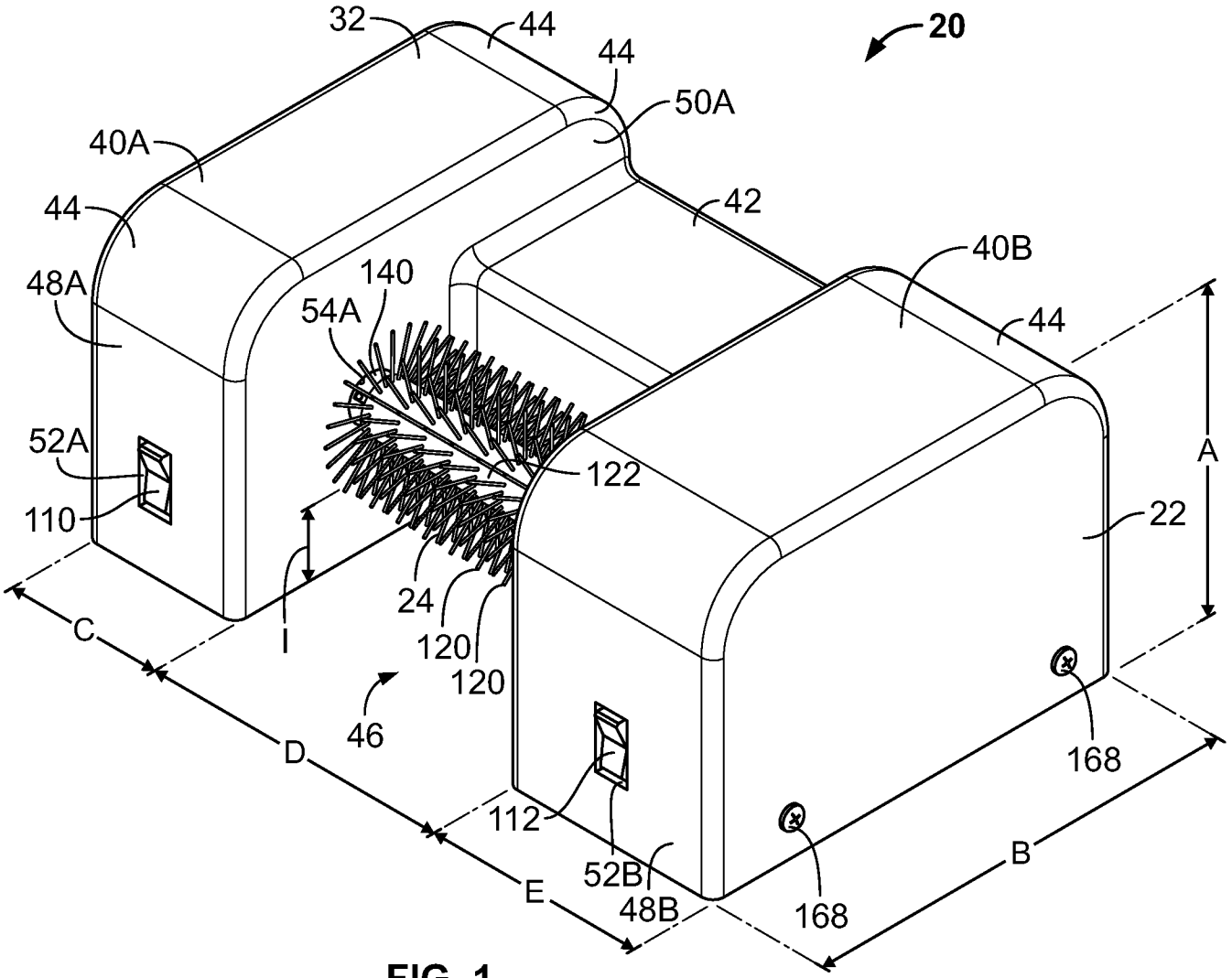
FIG. 1 is an isometric view of an embodiment of a scrubbing device.

FIGS. 1-9 depict a first embodiment of a powered scrubbing device 20. The powered scrubbing device 20 generally comprises a housing 22, a brush 24, a battery 26, a motor 28, and a transmission system 30. The housing 22 includes a cover 32 and a base housing 34. In this embodiment, the housing 22 is made of plastic, but it is contemplated that the housing 22 could be made of other materials capable of being using in wet environments.

Figure 2:
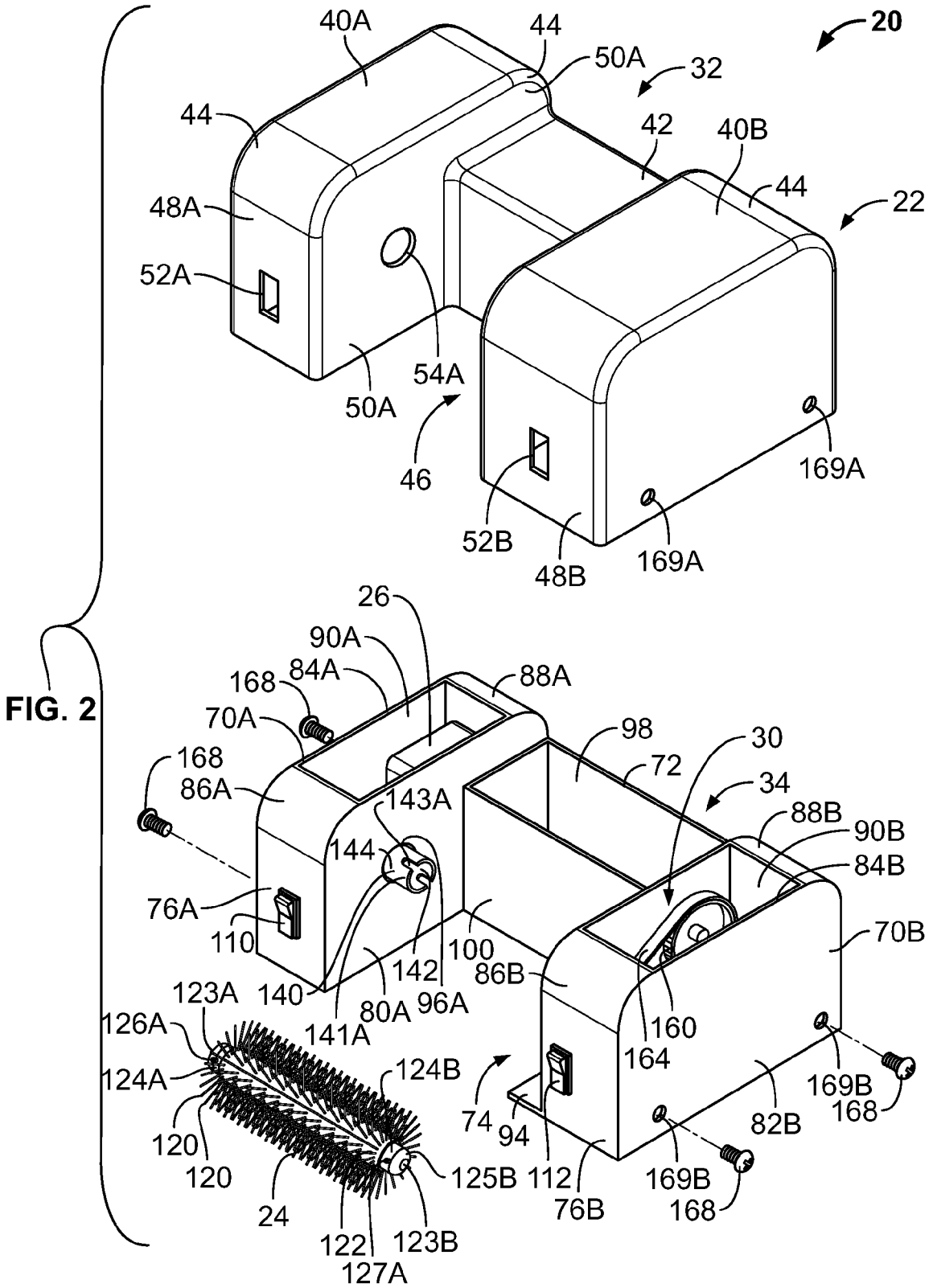
FIG. 2 is an exploded view of the scrubbing device of FIG. 1 showing a base housing, a cover housing, and a brush.
Figure 8:
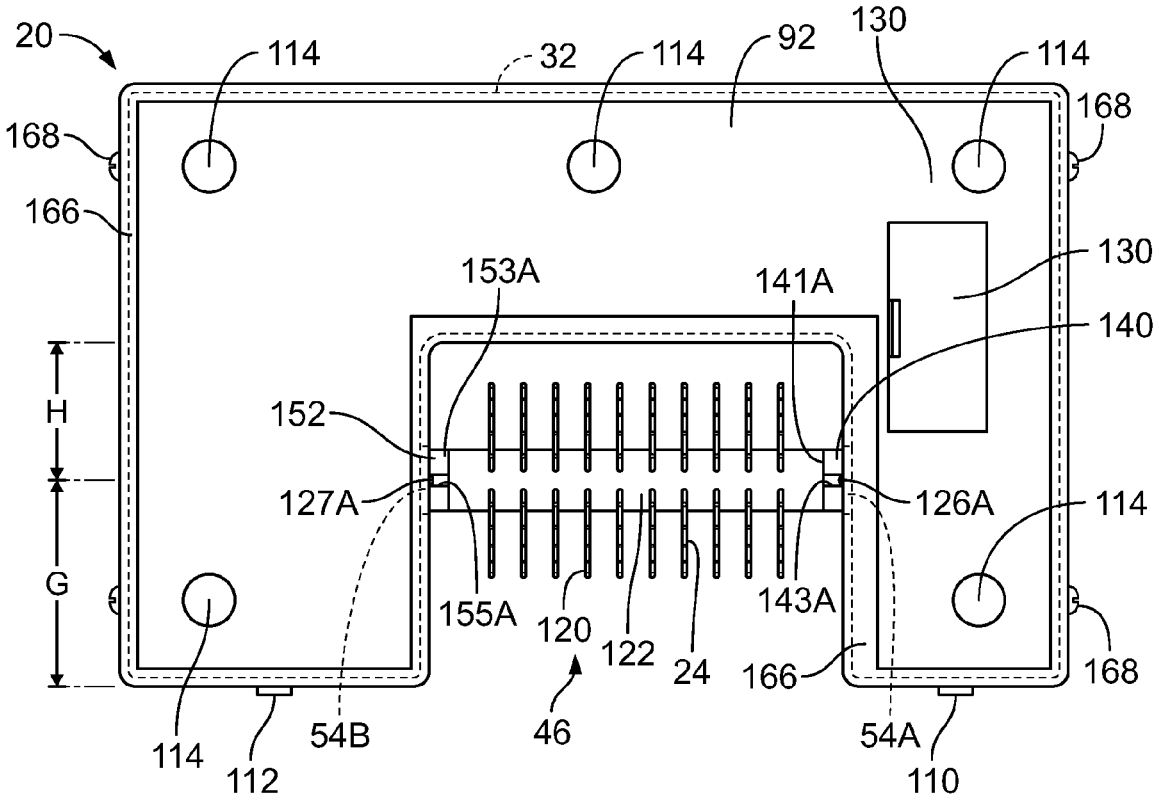
FIG. 8 is a bottom elevational view of the scrubbing device of FIG. 1.
Figure 9:
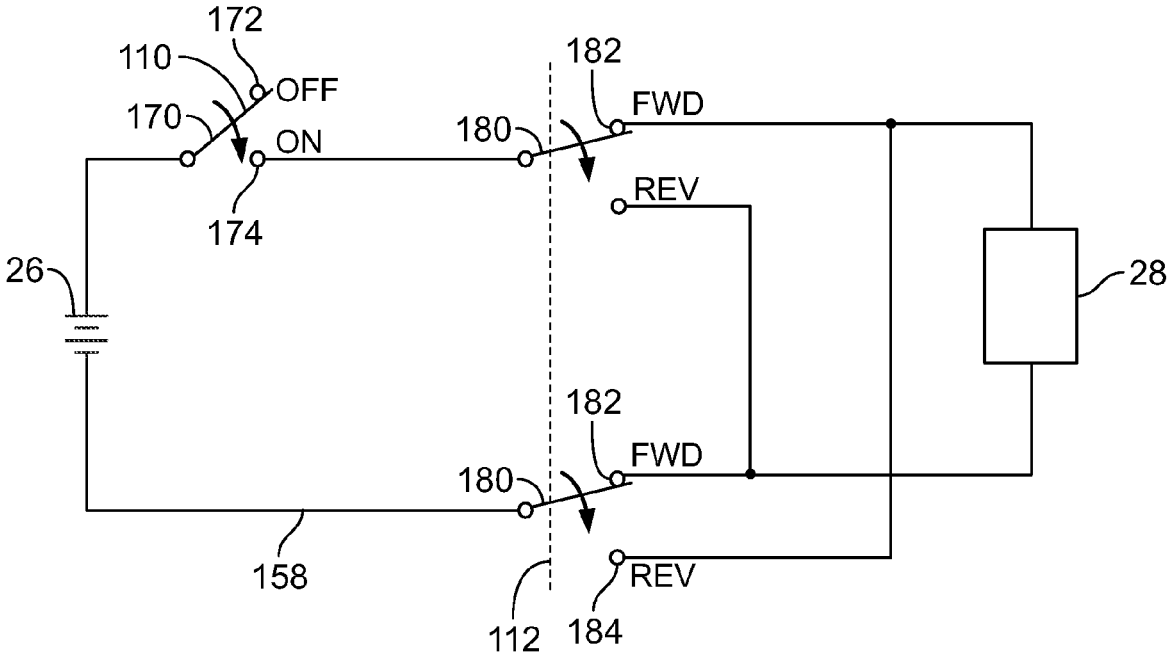
FIG. 9 is a schematic diagram showing an electrical circuit for controlling a motor of the scrubbing device of FIG. 1.

Referring more particularly to FIG. 2, the cover 32 of the housing 22 is generally U-shaped and is defined by a first, second, and third portions 40A, 40B, 42, respectively. The first, second, and third portions 40A, 40B, 42 are generally rectangular in shape preferably with rounded or chamfered upper edges 44. The third portion 42 extends transversely, and, more preferably substantially perpendicularly between and connects the first and second portions 40A, 40B. The first, second, and third portions 40A, 40B, 42 define a recess 46. Specifically, the first and second portions 40A, 40B, include front walls 48A, 48B, and inner sidewalls 50A, 50B, respectively, facing the recess 46. The front walls 48A, 48B of the first and second portions 40A, 40B include surfaces defining generally rectangular apertures 52A, 52B, respectively, which are generally centrally located on the front walls 48A, 48B. The inner side walls 50A, 50B include generally circular apertures 54A, 54B (the aperture 54B is shown in FIG. 8), respectively, which are located approximately midway up the inner side walls 50A, 50B, respectively.

Figure 3:
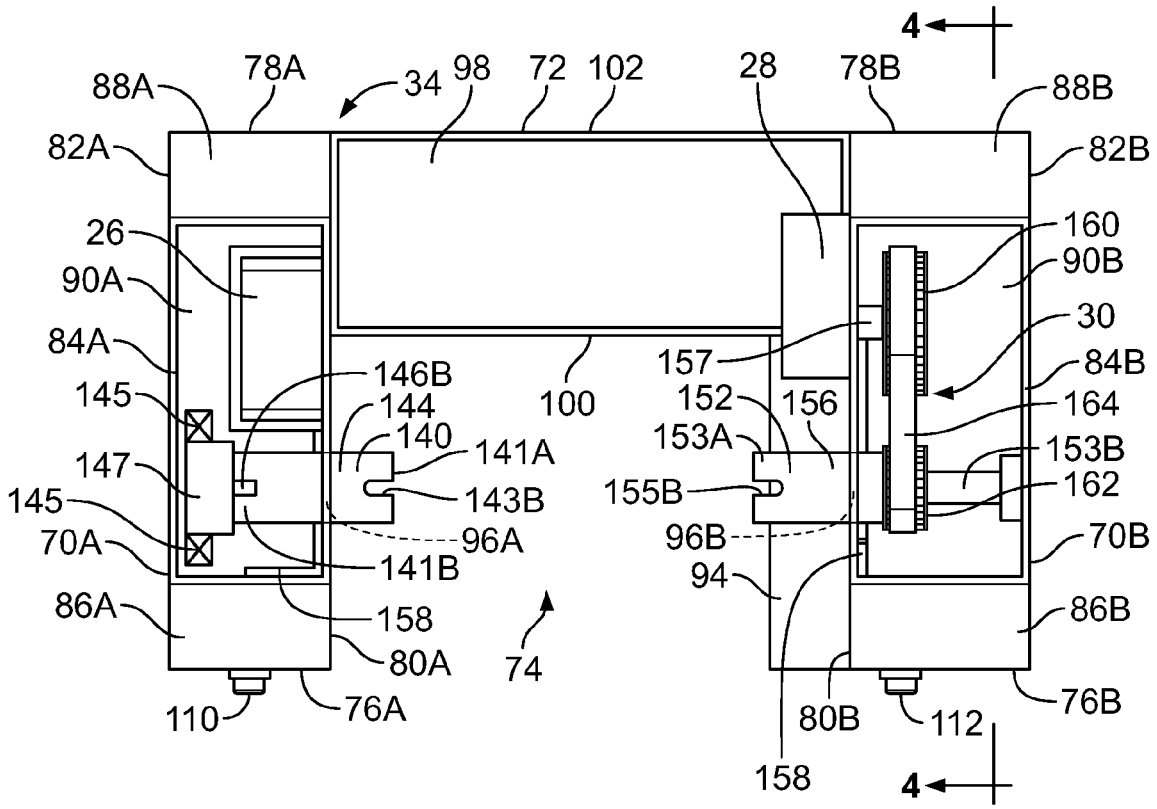
FIG. 3 is a plan view of the scrubbing device of FIG. 1 with the cover housing and brush removed.
Figure 4:
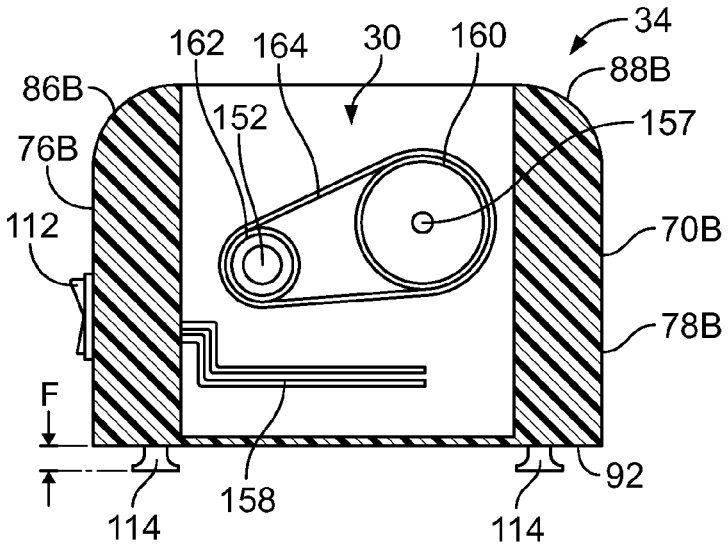
FIG. 4 is a cross-sectional view taken generally along the lines 4-4 of FIG. 3.

The base housing 34 comprises first and second base housing portions 70A, 70B, respectively, and a third base housing portion 72 as illustrated in FIGS. 2-4, and 7. The third base housing portion 72 extends transversely, and, more preferably, substantially perpendicularly between the first and second base housing portions 70A, 70B and connects the first and second base housing portions 70A, 70B creating a further recess 74. The first, second, and third base housing portions 70A, 70B, 72, respectively, create the U-shaped base housing 34 that is similar in shape to the U-shaped cover 32. The first base housing portion 70A includes front, rear, inner and outer side walls, 76A, 78A, 80A, 82A, respectively, and a top opening with front and rear curved edges 84A, 86A, 88A, respectively, that define a first hollow compartment 90A. The second base housing portion 70B includes front, rear, and inner and outer side walls, 76B, 78B, 80B, 82B, respectively, and a top opening with front and rear curved edges 84B, 86B, 88B, respectively, that define a second hollow compartment 90B separated from the recess 74 by the inner side wall 80B. A bottom 92 of the base housing 34 extends inwardly beyond the inner side wall 80B of the second base housing portion 70B, and into the recess 74, creating a platform 94. The inner side walls 80A, 8013 include surfaces defining generally circular apertures 96A, 96B (the aperture 96B is shown in FIG. 3), respectively, which are located approximately midway up the inner side walls 80A, 80B, respectively. Additionally, the third base housing portion 72 includes a third hollow compartment 98 disposed between the inner side walls 80A, 8013 of the first and second base housing portions 70A, 70B, respectively, and further defined by front and rear walls 100, 102, respectively.

Figure 7:
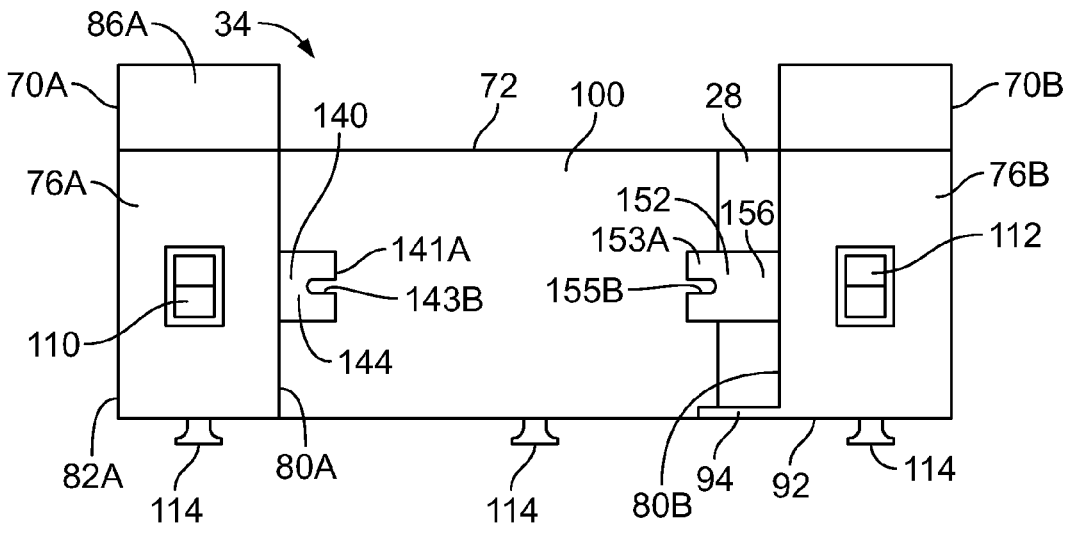
FIG. 7 is a front elevational view of the scrubbing device of FIG. 1 with the cover housing and the brush removed.

Referring to FIGS. 2, 3, and 7, a first switch 110 is disposed on the front wall 76A of the first base housing portion 70A. The first switch 110 is operable to energize the motor 28. A second switch 112 is disposed on the front wall 76B of the second base housing portion 70B. The second switch 112 is operable to select a direction of rotation of the motor 28. In the illustrated embodiment the first and second switches 110, 112, respectively, are shown as rocker switches, although other types of switches may be used. Additionally, suction cups 114 are mounted on the bottom 92 of the base housing 34. The suction cups 114 are capable of securing the device 20 to the floor of a shower or other location where the device 20 is being used.

Figure 5:
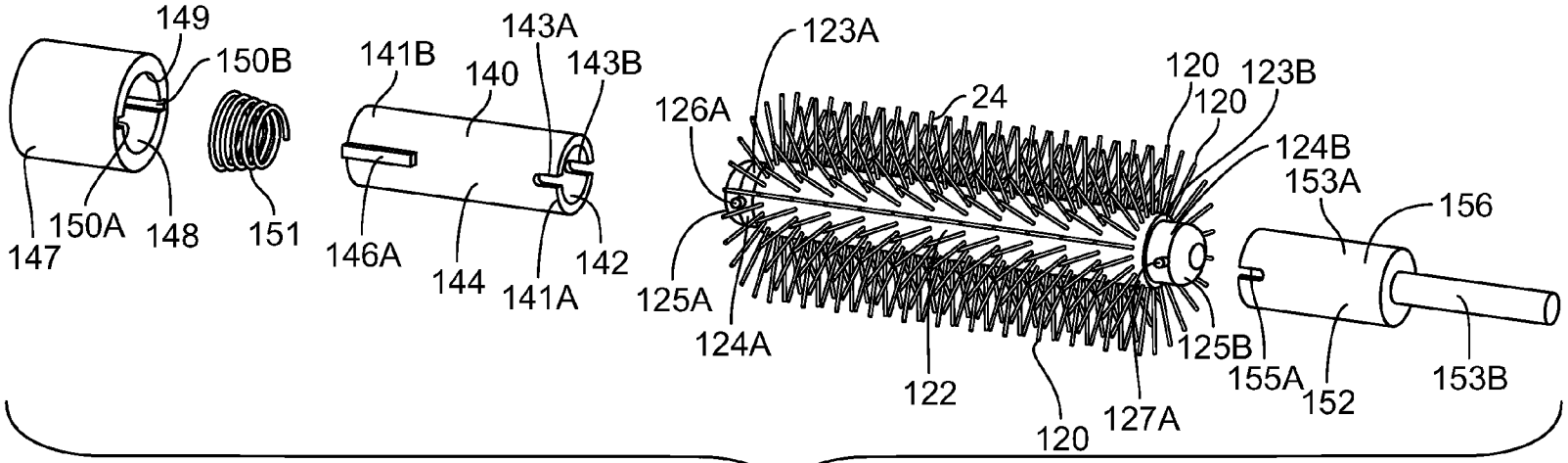
FIG. 5 is an exploded isometric view of a portion of the scrubbing device of FIG. 1 showing the brush and mounting assemblies.
Figure 6:
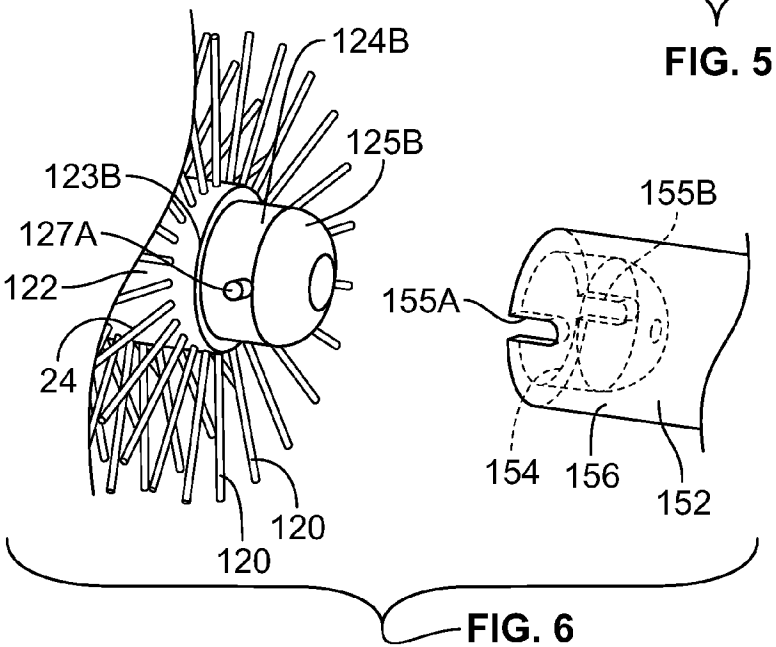
FIG. 6 is an enlarged, fragmentary, isometric view of FIG. 5 showing an end of the brush and associated mounting assemblies.

As shown in FIGS. 3, 5, and 6 a first mount 140 is disposed within the first compartment 90A. A first end 141A of the first mount 140 preferably (although not necessarily) extends through the generally circular aperture 96A of the sidewall 80A into the recess 74. The first end 141A of the first mount 140 includes a hollow member 142 having two opposing generally U-shaped slots 143A, 143B in a cylindrical wall 144. A second end 141B of the first mount 140 includes two opposing axially extending keys 146A, 146B (FIGS. 3 and 5 show the first mount 140 in two different positions displaced 90 degrees relative to one another such that the key 146A is visible in FIG. 5 and the key 146B is visible in FIG. 3). The second end 141B of the first mount 140 is received within a frame 147 disposed within the first compartment 90A. A journal bearing 145 is mounted within the first compartment 90A and journals the frame 147 for rotation. The frame 147 is cylindrical and includes a generally cylindrical hollow portion 148. Within an inner sidewall 149 of the hollow portion 148 are two opposing slots 150A, 150B designed to receive the axially extending keys 146A, 146B, respectively, to cause the frame 147 and the first mount 140 to rotate together. A spring 151 is disposed within the hollow portion 148 of the frame 147 and is designed to urge the first mount 140 inwardly (i.e., to the right as seen in FIG. 3). A suitable stop structure (not shown) is preferably provided in the compartment 90A to prevent the spring 151 from causing the first mount 140 to be moved out of the hollow portion 148. As noted in greater detail below, the first mount 140 is thus able to move laterally within the frame 147 in order to insert and remove the brush 24 into/from the device 20.

A second mount 152 is disposed within the second compartment 90B. A first end 153A of the second mount 152 extends through the generally circular aperture 96B of the sidewall 80B into the recess 74. The first end 153A of the second mount 152 includes a hollow portion 154 having two opposing generally U-shaped slots 155A, 155B in a cylindrical wall 156 of the first end 153A. A second end 153B of the second mount 152 is coupled to and rotatable with the transmission system 30.

As illustrated in FIGS. 1, 2, 5, and 8, the brush 24 is generally cylindrical, with bristles 120 extending angularly and/or perpendicularly from a central shaft 122. The bristles 120 can be made of plastic, nylon, rubber, or any other material known in the art. First and second ends 123A, 123B of the shaft 122 include cylindrical portions 124A, 124B and domed portions 125A, 125B, respectively. The domed portions 125A, 125B are shaped and sized to be received within the hollow portions 142, 154 of the first and second mounts 140, 152, respectively. A first post 126A extends radially outwardly from a side of the cylindrical portion 124A of the first end 123A of the shaft 122 and a second post (not shown) extends radially outwardly from an opposing side of the cylindrical portion 124A of the first end of the shaft 122 preferably (but not necessarily) substantially 180 degrees therefrom. Similarly, a third post 127A extends radially outwardly from a side of the cylindrical portion 124B of the second end 123B of the shaft 122 and a fourth post (not shown) extends radially outwardly preferably (but not necessarily) substantially 180 degrees from the post 127A from an opposing side of the cylindrical portion 124B of the second end 123B of the shaft 122. The first post 126A on the first end 123A of the shaft 122 is shaped and sized to be received within the cutout 143A on the first mount 140 and the second post on the first end 123A of the shaft 122 is shaped and sized to be received within the cutout 143B on the first mount 140. The third post 127A on the second end 123B of the shaft 122 is shaped and sized to be received within the cutout 155A on the second mount 152 and the fourth post on the second end 123B is shaped and sized to be received within the cutout 155A on the second mount 152. The cutouts 143A, 143B, 155A, 155B and first through fourth posts lock the shaft 122 of the brush 24 within the first mount 140 and the second mount 152, allowing the brush 24 and the mounts 140, 152 to rotate as a single unit. The brush 24 can be removed from the device 20 by laterally moving the brush 24 toward the first portion 40A of the device 20, causing the first mount 140 to compress the spring 151 within the frame 147. The second end 123B of the shaft 122 is then spaced from and can be removed from the second mount 152, thereby allowing the first end 123A of the shaft 122 to be removed from the first mount 140. The brush 24 can thereby be removed from the device 20 for replacement or cleaning. The brush 24 or any other scrubbing, exfoliating, and/or other rotatable element can be inserted in the device 20 by reversing the above steps.

The battery 26 is disposed within the first compartment 90A of the base housing 34 as illustrated in FIGS. 2 and 3. The battery 26 in the present embodiment is an 18V LI-ion rechargeable battery, although one or more other batteries may be used to provide power to the motor 28.

Figure 10:
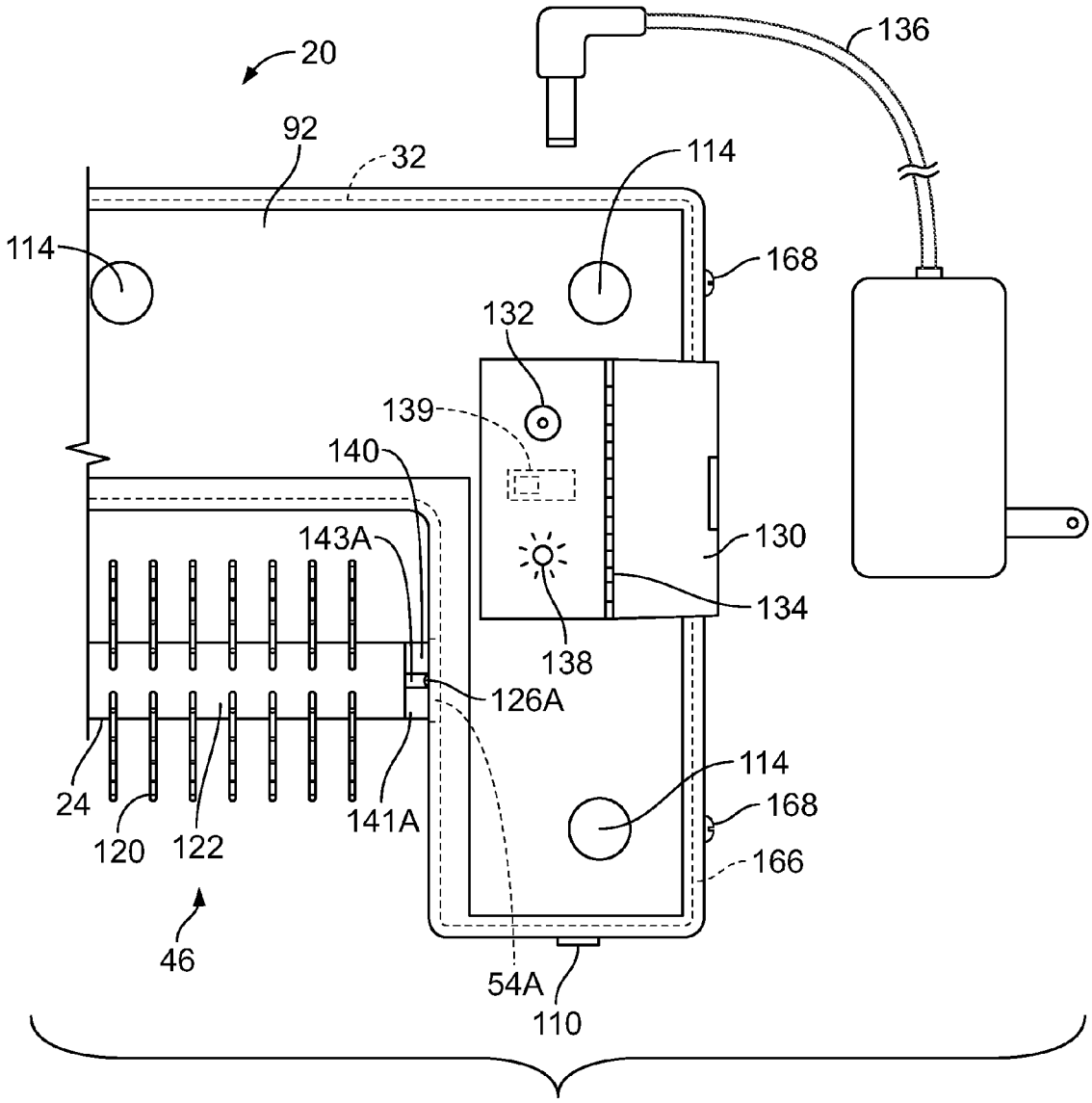
FIG. 10 is a bottom elevational view of another scrubbing device with a waterproof access door opened to show internal connections for charging a battery.

Referring to FIG. 8, a waterproof door 130 is disposed in the bottom 92 of the base housing 34 below the first compartment 90A. The waterproof door 130 provides access to the battery 26, so that the battery 26 can be removed from the device 20 for replacement or recharging. It is also contemplated, in another embodiment, that the waterproof door 130 may provide access to a power receptacle 132 (shown in FIG. 10) disposed behind the waterproof door 130. Elements common to the embodiment in FIG. 10 are assigned like reference numerals. A hinge 134 connects the waterproof door 130 to the bottom 92 of the base housing 34 and allows the waterproof door 130 to be opened. The hinge 134 is illustrated as a piano hinge although the hinge 134 may be a different type of hinge, such as a living hinge. A seal (not shown), or any other suitable member, is disposed on the waterproof door 130 to prevent water from entering the device 20. The power receptacle 132 is adapted to receive a power cord 136 capable of being plugged into a standard wall outlet in order to charge the battery 26, while the battery 26 is contained within the housing 22. In such an embodiment, the battery 26 is not normally removed from the base housing 34 and charging of the battery is not typically undertaken while the device 20 is not in a wet environment. Additionally, an LED 138, or other indicator, may be disposed behind the waterproof door 130 to inform the user that the battery 26 is charging. An optional master switch 139 may be disposed behind the waterproof door 130 to prevent the first and second switches 110, 112, respectively, from controlling the device 20.

Referring now to FIGS. 3 and 7, the motor 28 is mounted substantially within the third compartment 98 of the base housing 34. The portion of the motor 28 not within the third compartment 34 is mounted on the platform 94 outside of the second compartment 90B. A drive shaft 157 extends from the motor 28 through the inner side wall 80B of the second compartment 90B connecting the motor 28 to the transmission system 30. In the illustrated embodiment the motor 28 is an 18V DC motor, although other motors may be used. The motor 28 is coupled to the battery 26 and the first and second switches 110, 112 with wires 158 located in the base housing 34 as generally illustrated in the electric circuit schematic shown in FIG. 9.

The transmission system 30 in the present embodiment includes a large pulley 160, a small pulley 162, and a belt 164. The belt 164 connects the large pulley 160 and the small pulley 162. The large pulley 160 is, in turn, coupled to the drive shaft 157 of the motor 28 and the small pulley 162 is coupled for rotation with the second mount 152, which, as noted above, is coupled to the shaft 122 of the brush 24. The sizes of the large pulley 160 and the small pulley 162 are selected to control the speed of rotation of the brush 24 and the torque delivered by the motor 28. Although the present embodiment includes a belt 164 and pulleys 160, 162, other transmission systems, such as a gear train, may be used to transfer motion from the motor 28 to the brush 24. Also, the pulleys 160, 162 and belt 164 may be toothed or not toothed, as desirable or necessary.

Referring now to FIGS. 1 and 2, once the components are assembled within the base housing 34 the cover 32 is then slid over the base housing 34. The first, second, and third portions 40A, 40B, 42, respectively, of the cover 32 are sized to receive and cover the first, second, and third base housing portions 70A, 70B, 72, respectively. The second portion 40B of the cover 32 is sized to cover also the platform 94 extending inwardly beyond the second base housing portion 70B and the portion of the motor 28 mounted on the platform 94. The generally rectangular apertures 52A, 52B in the front walls 48A, 48B of the cover 32 are sized to receive the first and second switches 110, 112, respectively. Also, the generally circular apertures 54A, 54B in the cover 32 are sized to receive the first and second brush mounts 140, 152, respectively, when the cover is slid over the base housing 34. As described in greater detail above the first mount 140 can move laterally toward the side wall 80, which facilitates sliding the cover 32 over the base housing 34. Additionally, the material of the cover 32 is sufficiently flexible to permit temporary deformation thereof so that the front walls 48A, 48B of the cover 32 can be moved over the switches 110, 112 and so that the inner side walls 50A, 50B can be moved over the mounts 140, 152, respectively. Such walls thereafter snap back to an undeformed state so that the switches 110, 112 are captured within the apertures 52A, 52B, respectively, and the mounts 140, 152 extend inwardly through the apertures 54A, 54B into the recess 46. The cover 32 rests atop and sealingly engages a gasket 166 (shown in FIGS. 8 and 10) extending around the bottom of the base housing 34. The cover 32 and gasket 166 create a water-tight seal to keep water from entering the housing 22. The gasket 166 is shown extending around the bottom of the base housing 34, although it is contemplated that the gasket 166 can be mounted on and carried by a platform (not shown) disposed below and secured to the base housing 34. Fasteners such as screws 168 extend through holes 169A in the cover 32 into holes 169B in the base housing 34. The screws 168 hold the cover 32 and the base housing 34 together.

The weight of the device 20 is preferably between about 8 and about 12 lbs, more preferably between about 9 and about 11 lbs, and most preferably about 10 lbs. These weights are illustrative only, it being understood that the device 20 is preferably light enough to be portable, while still having enough weight and/or having securing means (such as the suction cups 114) so that the device 20 does not move when in use. The preferred dimensions of the device 20 are listed in the table below and are shown in FIGS. 1-8 (the dimensions provided herein are exemplary only and should not be construed as limiting):

TABLE

| | | |
|---|---|---|
| A | 5 ½ in. | 14.0 cm. |
| B | 8 ¾ in. | 22.2 cm. |
| C | 4 ¼ in. | 10.8 cm. |
| D | 6 in. | 15.2 cm. |
| E | 3 ¼ in. | 8.3 cm. |
| F | 5/16 in. | 0.8 cm. |
| G | 3 1/16 in. | 7.8 cm. |
| H | 2 3/16 in. | 5.6 cm |
| I | 1 ½ in. | 3.8 cm. |

Reference letter A refers to the height of the cover 32 and B refers to the depth of the cover 32. Reference letters C and E denote the width of the second and first portions 40B, 40A, respectively, and D refers to the distance between the first and second portions 40A, 40B. Reference letter F identifies the uncompressed height of the suction cups 114. Reference letters G and H refer to the distance from the axial center of the shaft 122 of the brush 24 to front walls 48A, 48B, and to the front wall 100 of the third portion 42 of the cover 32, respectively. Reference letter I denotes the clearance between the brush 24 and the bottom of the cover 32.

In use, a user moves the first switch 110 to an on position. The user can move the first switch 110 by reaching down to press the first switch 110 with a finger, or the user can move the first switch 110 with a toe. Referring also to the electrical schematic diagram of FIG. 9, when the first switch 110 is so moved a wiper 170 is moved from an off contact 172 to an on contact 174 and the battery 26 is connected to and provides energy to the motor 28, causing the drive shaft 157 of the motor 28 to rotate in a direction determined by the position of the second switch 112. The drive shaft 157 rotates the large pulley 160, which rotates the small pulley 162 through the movement of the belt 164. The second mount 152 and the shaft 122 connected to the second mount 152 are thereby rotated causing the brush 24 to spin. While the brush 24 is spinning a user can place a foot above the brush 24 to scrub a bottom of the foot. The user may also place the foot below the brush 24 as the brush is spinning to scrub top surfaces and toenails of the foot. At any time during use the user can move (i.e., toggle) the second switch 112 in the same manner as the first switch 110 to reverse the direction of rotation of the motor 28. When the second switch is so moved, wipers 180 are moved from forward contacts 182 to reverse contacts 184 and the direction of rotation of the motor 28 is thereby reversed, reversing the direction of rotation of the brush 24. For example, the user may advantageously cause the brush 24 to spin in a first direction when the user's foot is placed below the brush 24 so that the spinning of the brush 24 tends to pull the foot into the device 20. In such a case, the user's foot may engage the third portion 42 of the cover 32 acting as a stop to prevent over-insertion of the foot into the device 20. Alternatively, the direction of rotation may be reversed from that described above when the user's foot is to be placed atop the brush 24 to access same whereby that the user pulls his/her foot from the back to the front of the device 20 against the spinning force of the brush 24.

Figure 11:
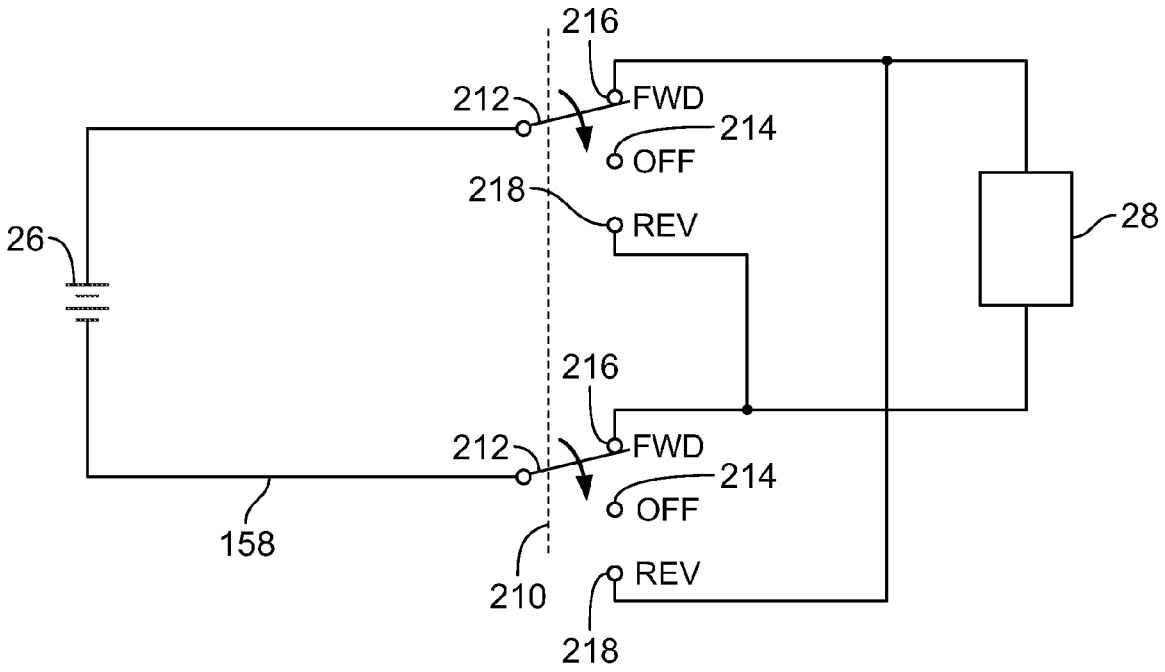
FIG. 11 is a schematic diagram showing a further embodiment of an electrical circuit for controlling a motor using one switch.

A further embodiment of the device is illustrated in FIG. 11. Elements common to the embodiment in FIG. 11 are assigned like reference numerals. In this embodiment, the device 20 includes only one switch 210 for controlling the device 20. The single switch 210 may be of the two-pole, three-throw type that can energize the motor 28 and change the direction of rotation of the motor 28. The switch 210 can be a rocker switch, a sliding switch, or any other switch capable of switching between a forward, off, and reverse setting. When the single switch 210 is moved from a neutral to a forward position, wipers 212 are moved from off contacts 214 to forward contacts 216 and the motor 28 is powered to rotate in a forward direction. When the single switch 210 is moved from the neutral position to a reverse position the wipers 212 are moved from the off contacts 214 to reverse contacts 218 and the motor 28 is powered to rotate in a reverse direction.

It is further contemplated that any of the described embodiments could include a remote switch or switches as opposed to the first and second switches 110, 112, respectively, located on the housing 22. Locating such switch(es) remotely has the advantage of allowing the user to activate the device 20 or reverse the direction of the rotation of the motor 28 without having to reach down to toggle a switch or switches.

It is also contemplated that the above embodiments may be modified to include other sources of motive power coupled to the brush 24 instead of the electric motor 28 and battery 26. For example, it is contemplated that the device 20 could be adapted to receive a hose for running water through the device 20. The water running through the device 20 would turn a water wheel located within the housing 22. The water wheel would transmit the movement of the water to the brush 24, causing the brush 24 to spin.

Various modifications can be made to the above embodiments without departing from the spirit of the present disclosure. For example, instead of one brush the device 20 can be adapted to include multiple brushes with a transmission system adapted as would be evident to one of ordinary skill in the art to permit motive power transfer to such brushes. Additionally, it is contemplated that other scrubbing members instead of the brush 28 could be used with the device 20. The brush 28 could be replaced with a pumice stone, a loofah, a rubber pad, a cloth covered cylinder, or any other material or device capable of scrubbing and/or exfoliating the feet, without departing from the spirit of the present disclosure.

Other embodiments of the disclosure including all the possible different and various combinations of the individual features of each of the foregoing described embodiments and examples are specifically included herein.

INDUSTRIAL APPLICABILITY

The device described herein advantageously allows for the cleaning and exfoliating of feet without the at-times significant challenge of having to reach the feet. The device includes powered brushes and may be used in wet or dry environments. Additionally, the device is portable and thus may be moved to different locations for use.

Numerous modifications to the present disclosure will be apparent to those skilled in the art in view of the foregoing description. Accordingly, this description is to be construed as illustrative only and is presented for the purpose of enabling those skilled in the art to make and use the present disclosure and to teach the best mode of carrying out same.

I claim:

1. A powered scrubbing device, comprising:

a portable housing including a recess disposed within outer margins of the housing wherein the recess is defined by first and second opposing side walls and a third side wall extending transversely between the first and second side walls, wherein the first and second opposing side walls extend between front and rear faces of the housing;

a scrubber member journaled for rotation within the recess and extending between facing surfaces of the opposing side walls, wherein the scrubber member divides the recess into first and second recess portions; and a source of motive power coupled to the scrubber member to rotate the scrubber member selectively in either of first and second directions;

wherein the first recess portion is sized to accommodate a foot of a user and the second recess portion permits access to an upper surface of the scrubber member; and wherein the first and second opposing side walls have a first height and the third side wall has a second height less than the first height such that the upper surface of the scrubber member is accessible from the front and rear faces of the housing.

2. The scrubbing device of claim 1, wherein the third wall connects the first and second side walls.

3. The scrubbing device of claim 1, wherein the third side wall extends perpendicularly between the first and second side walls.

4. The scrubbing device of claim 1, further including bearings within the housing disposed behind the first and second walls, wherein the scrubber member is journaled by the bearings.

5. The scrubbing device of claim 1, wherein the housing is waterproof and wherein the source of motive power is an electric motor.

6. The scrubbing device of claim 5, further including a switch for activating the motor.

7. The scrubbing device of claim 5, further including a switch for changing the direction of rotation of the motor.

8. The scrubbing device of claim 5, further including a battery coupled to the motor.

9. The scrubbing device of claim 8, wherein the battery is disposed within the housing and wherein the battery is removable from the housing for charging.

10. The scrubbing device of claim 8, wherein the battery is disposed within the housing and wherein the battery is rechargeable within the housing.

11. The scrubbing device of claim 10, further including a power receptacle disposed within the housing behind a waterproof access door, wherein an electrical cord is plugged into the power receptacle for charging the battery.

12. The scrubbing device of claim 1, further including suction cups attached to a bottom wall of the housing.

13. The scrubbing device of claim 1, wherein the scrubber member comprises a brush.

14. A powered scrubbing device comprising:

a portable, waterproof housing including a recess defined by first and second opposing side walls and a third side wall extending perpendicularly between and connecting the first and second side walls, wherein the first and second opposing side walls extend between front and rear faces of the housing;

a scrubber member journaled for rotation within the recess and extending between facing surfaces of the opposing side walls;

an electric motor disposed within the housing and coupled to the scrubber member to rotate the scrubber member selectively in either of first and second directions;

a battery disposed within the housing and coupled to the motor; and a switch for controlling motor actuation;

wherein the recess is sized to accommodate a foot of a user below the scrubber member and the recess is sized to permit access to an upper surface of the scrubber member; and wherein the first and second opposing side walls have a first height and the third side wall has a second height less than the first height such that the upper surface of the scrubber member is accessible from the front and rear faces of the housing.

15. The scrubbing device of claim 14, wherein the battery is removable from the housing for charging.

16. The scrubbing device of claim 14, wherein the battery is rechargeable within the housing.

17. The scrubbing device of claim 14, wherein the scrubber member comprises a brush.

18. A powered scrubbing device, comprising:

a portable, waterproof, U-shaped housing including first and second opposing portions and a third portion extending perpendicularly between and connecting the first and second portions, wherein the first and second opposing portions extend between front and rear faces of the housing;

a brush journaled for rotation between the first and second portions by first and second bearings disposed within the first and second portions respectively and extending between facing surfaces of the opposing portions;

an electric motor disposed within the second portion and coupled to the brush;

a switch for energizing the motor, wherein the motor is operable to rotate the brush in either of two directions; and a battery disposed within the first portion and coupled to the motor by the switch;

wherein the housing is sized to accommodate a foot of a user below the brush and the housing is sized to permit access to an upper surface of the brush; and wherein the first and second opposing portions have a first height and the third portion has a second height less than the first height such that the upper surface of the brush is accessible from the front and rear faces of the housing.

19. The scrubbing device of claim 18, wherein the battery is removable from the housing for charging.

20. The scrubbing device of claim 18, wherein the battery is rechargeable within the housing.

* * * * *